United States Patent [19]

Perel et al.

[11] 4,318,028

[45] Mar. 2, 1982

[54] ION GENERATOR

[75] Inventors: Julius Perel, Altadena; John F. Mahoney, Pasadena, both of Calif.

[73] Assignee: Phrasor Scientific, Inc., Duarte, Calif.

[21] Appl. No.: 59,240

[22] Filed: Jul. 20, 1979

[51] Int. Cl.[3] ..... H01J 27/02; H01J 20/02

[52] U.S. Cl. ..... 315/111.81; 250/423 R; 313/231.01; 313/362.1

[58] Field of Search ..... 315/111, 111.2, 111.8, 315/111.9; 313/362, 231, 231.3; 250/423 R, 427

[56] References Cited

U.S. PATENT DOCUMENTS

| | | | |
|---|---|---|---|
| 3,233,404 | 2/1966 | Huber et al. | 313/362 X |
| 3,304,719 | 2/1967 | Ducati | 313/362 X |
| 3,579,028 | 5/1971 | Paine | 315/111.2 |
| 3,903,891 | 9/1975 | Brayshaw | 315/111.2 X |

FOREIGN PATENT DOCUMENTS

| | | | |
|---|---|---|---|
| 2287792 | 5/1976 | France | 315/111.9 |

*Primary Examiner*—Eugene R. La Roche

*Attorney, Agent, or Firm*—Paul L. Gardner

[57] ABSTRACT

An improved system for generating an ion beam comprises a nozzle through which a gas to be ionized is fed, and a ring electrode encircling the tip of the nozzle. High positive potential and negative potential are applied to the nozzle and ring electrode, respectively, to create a high intensity electric field. The gas atoms passing through the capillary nozzle are ionized, and the ions so created are accelerated in a direction forwardly from the nozzle by the field. The current level or "brightness" of the ion beam so generated may be controlled by varying the pressure of the gas supplied to the nozzle, or the electrical potential difference applied between the nozzle and ring electrode.

16 Claims, 1 Drawing Figure

ION GENERATOR

FIELD OF THE INVENTION

The present invention relates to means and methods for generating ion beams.

BACKGROUND OF THE INVENTION

Ion beams have been found to be useful in a variety of different technologies, such as in highly controlled ion implantation, surface etching or milling, sputtering, mass spectrographs, submicron lithography, microelectronic circuit fabrication, electric propulsion devices, and microthrusters for station keeping or attitude control of satellites, to name a few.

Currently available means and methods of generating ion beams are subject, however, to a number of drawbacks which significantly limit their performance, efficiency, utility and scope of use. Such limiting drawbacks of prior art ion sources or generators include the following:

(1) The obtainable "brightness" of the generated ion beam currents (i.e., ion current per unit area per unit solid angle) of prior art ion sources is limited.

(2) The prior art apparatuses are relatively "delicate," frequently resulting in life-limiting operation. For example, in the prior art electron-bombardment type sources, filament cathodes or oxide cathodes, and cathode heaters or arc voltage supplies are required.

(3) The prior art ion sources are relatively complex, cumbersome, difficult and expensive to manufacture and operate.

OBJECTS AND SUMMARY OF THE INVENTION

In view of the foregoing, the objects of the present invention include the provision of improved methods and apparatuses for generating ion beams which are simpler, less delicate, smaller, more compact, less expensive and more efficient and effective than prior art ion sources.

A further object is the provision of an ion generator by means of which ion beam currents of greater intensity or "brightness" may be readily obtained.

The foregoing and other objects and advantages have been realized by the methods and apparatuses of the present invention by means of which ion beams of relatively high "brightness" may be generated by feeding a gas, ionized by a plasma discharge near the end of a capillary nozzle, through a relatively high intensity field which is created by applying higher and lower electric potentials, respectively, to the gas nozzle and a ring electrode encircling the nozzle.

Numerous other objects and advantages attendant to the present invention will be realized from a review of the exemplary embodiments described below and illustrated in the accompanying drawing.

BRIEF DESCRIPTION OF THE DRAWING

In the accompanying drawing:

The FIGURE is a schematic diagram depicting a system for generating ions from the gaseous or vapor state according to the present invention.

DESCRIPTION OF PREFERRED EMBODIMENTS

Figure 1:
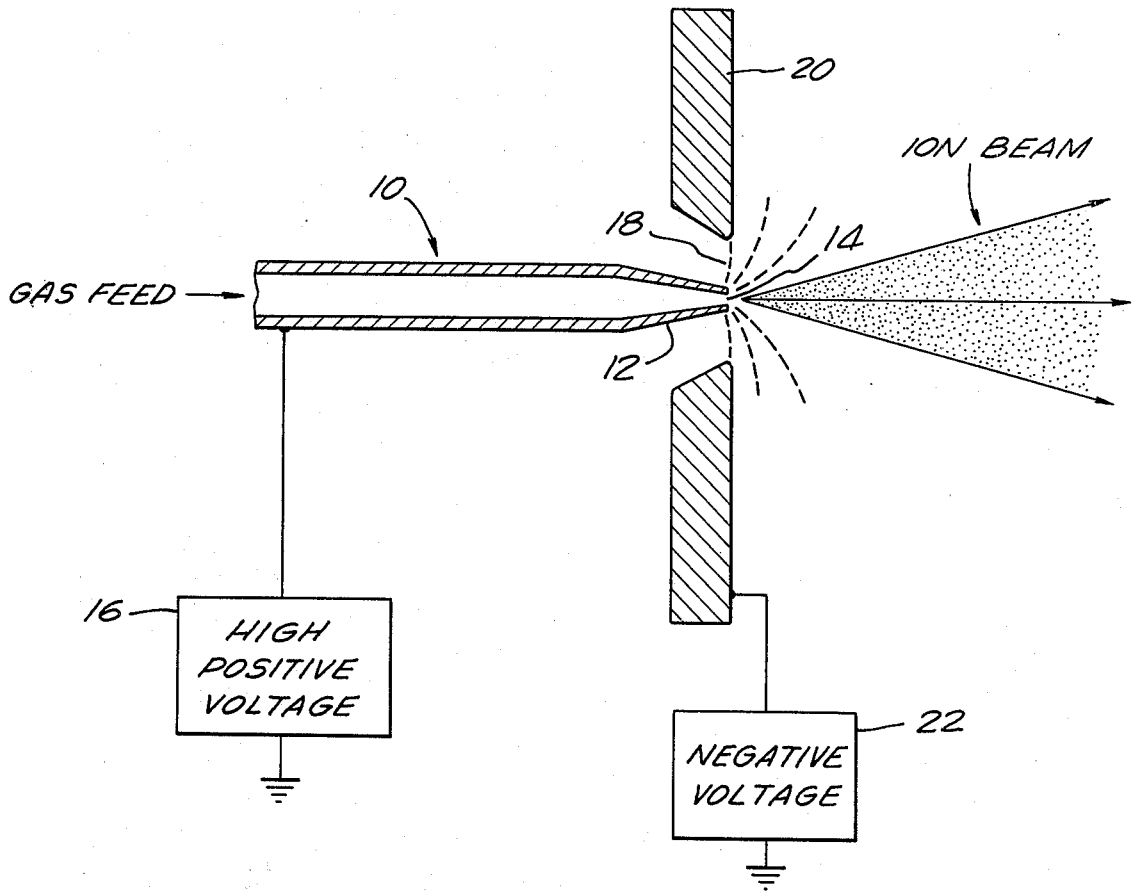

Referring to the FIGURE, the system of the present invention comprises a capillary nozzle 10 having a conical-shaped tip 12 with a "micro-orifice" or "pinhole" 14 extending through the outer end or apex. The nozzle 10 is electrically connected to a high positive voltage source 16.

The tip 12 of the nozzle is disposed within the central aperture 18 of a ring electrode 20 which encircles the tip. A negative voltage source 22 is electrically connected to the ring electrode 20, whereby a high intensity electric field (indicated by a pattern of broken lines in FIG. 1) may be created between the nozzle tip 12 and the peripheral wall of the central aperture 18 of the ring electrode 20.

Gas to be ionized is fed to the nozzle 10 from any suitable source (not shown), as indicated by the arrow and legend "gas feed" in FIG. 1.

In operation, the nozzle 10 is connected to the gas source (not shown) via any suitable connection, such as a connecting tube (not shown) extending between the gas source and the nozzle, and the gas to be ionized is fed therethrough at a predetermined desired pressure. Electrical potential is supplied to the nozzle 10 and ring electrode 20, via sources 16 and 22, respectively, whereupon a plasma is formed inside the nozzle by virtue of the collision of atoms of the gas to be ionized with electrons liberated from the capillary wall (and/or from within the plasma itself). Ions which reach the nozzle orifice 14 are accelerated outward by the strong divergent electric field generated between the nozzle tip 12 and the ring electrode 20 to form a smooth steady state "ion beam" as illustrated and labeled in the FIGURE.

While not shown in the drawing, it is contemplated that the ion beam generated will be readily incorporated into any apparatus constructed in accordance with the teachings of the present invention.

The ion beam current level, or "brightness," may be controlled by varying the pressure of the gas fed to the nozzle 10, and/or by varying the potential applied to the nozzle 10 and ring electrode 20 to vary the strength of the field created therebetween. Nearly instantaneous turn-on and turn-off operation may be obtained by lowering the potential applied to the nozzle 10 to a level below the "onset" potential for initiating ion current flow, and/or by reducing the pressure of the gas fed to the nozzle 10 to a level below that required to initiate an ion beam current. This feature is particularly advantageous when the present invention is utilized for pulsed operation of electric propulsion devices, for example.

The micro-orifice or pinhole 14 may be on the order of 1 to 100 microns. A capillary nozzle having a pinhole of about 50 microns has been proven to perform satisfactorily.

Operation of the pinhole ion source is not dependent on the geometry of the delivery system used to connect the source of gas to be ionized to the nozzle 10.

Nozzles fabricated from metallic conductors result in superior performance, although ceramic or quartz nozzles operate satisfactorily. For example, metallic nozzles yield higher ion beam current densities and operate at lower nozzle potentials compared with nozzles constructed from other materials.

The small dimension of the conical-shaped tip 12 of nozzle 10 enhances the electrical field in the region of the micro-orifice or pinhole 14 when potentials of 0–15 kilovolts are applied to the nozzle via potential source 16. The intense, highly divergent field at the orifice is believed to be responsible for the initiation of current, and also aids in rapid removal of ions formed inside the capillary and/or outside, near the orifice.

The diameter of the apex of the tip 12 of nozzle 10 is preferably about three times the diameter of micro-orifice 14.

By way of example, with the nozzle dimensions as indicated above, the diameter of the central apertue 18 in ring electrode 20 may be on the order of about 0.125 of an inch.

To date, the ion source of the present invention has been operated with gaseous species such as argon, hydrogen and helium. Source operation is not restricted, however, to monatomic species since molecular gases will form ion beams as well.

With respect to the source (not shown) of the gas to be ionized, the source may be connected via any suitable tubing to the nozzle 10. It is contemplated that instead of employing a source of pressurized gas, the gas to be ionized may be generated by heating solid or liquid source material in a suitable crucible and feeding the vapor generated thereby to the nozzle 10 in a manner conventional, per se.

With respect to the electrical potentials applied to the nozzle 10 and the ring electrode 20, potentials in the range of 0–15 kilovolts or more may be applied to the nozzle 10 via the moderately high voltage power supply 16; and a potential between about −1 kilovolt and a small positive potential (depending on the potential applied to the nozzle 10) may be applied to the ring electrode via negative voltage source 22.

It will be understood by those skilled in the art that, for a given range, the larger the voltage potential between the nozzle 10 and electrode 20, the greater number of ions generated, the greater the ion beam current or "brightness," and the greater the energy. Of course, the voltage potential should not be so high as to create a breakdown across the nozzle 10 and electrode 20.

As indicated above, the ion beam current or "brightness" may also be controlled by controlling the pressure of the gas supplied. In this case, care should be taken, of course, that the pressure escaping from the nozzle is not so high as to create a discharge rather than generate a strong beam.

With repect to theory of operation, it is believed that as soon as the voltages from sources 16 and 22 are applied to the nozzle 10 and electrode 20, respectively, to generate the high intensity electric field between the nozzle 12 and the periphery of electrode aperture 18, a free electron will find its way into the gas to be ionized and will there collide with a gas molecule to produce an ion. This will liberate another electron; and so the process continues to create an avalanche effect. It is believed that some ions will be formed some distance back into the tip 12 of capillary nozzle 10. The ions so created move towards the interior wall of the nozzle and liberate other electrons when they hit the wall. Some of the ions reach the tip of the nozzle, where they "see" the high intensity electric field and are accelerated forwardly thereby.

It is contemplated that the potential applied to the nozzle may be negative, in which case the apparatus will form an elecrtron or negative ion beam to serve as an electron or negative ion source.

It is contemplated, of course that numerous modifications and additions may be made to the particular embodiments described above without departing from the spirit of the present invention. By way of example, only, it is contemplated that a plurality or array of nozzles may be employed with a single electrode having a plurality of apertures to provide a plurality of electrode systems to establish the intense electric field at each nozzle outlet.

Accordingly, it is intended that the scope of this patent be limited only by the scope of the appended claims.

We claim:

1. An improved apparatus for generating a high intensity ion beam, comprising:

a nozzle having an inlet end adapted to communicate with a source of a species to be ionized, an outlet end, and a passage extending therethrough and terminating in a relatively small orifice at said outlet end; and means for generating an electrostatic field at said outlet end of said nozzle of sufficiently high intensity to produce a high intensity ion beam caused by collisions of electrons with atoms of the species.

2. An improved ion generating apparatus according to claim 1, wherein said means for generating an electrostatic field comprises a ring electrode having a central aperture, and wherein said outlet end of said nozzle is positioned approximately in the center of said aperture.

3. An improved ion generating apparatus according to claim 1, wherein said outlet end of said nozzle is in the form of a conical tip.

4. An improved ion generating apparatus according to claim 1, wherein said outlet end of said nozzle has a very small diameter opening therein, on the order of about between 1 and 100 microns in diameter.

5. An improved ion generating apparatus according to claim 1, wherein said nozzle is fabricated of a metallic conductor material.

6. An improved ion generating apparatus according to claim 1, wherein said nozzle is fabricated of a ceramic material.

7. An improved ion generating apparatus according to claim 1, wherein said nozzle is fabricated of quartz.

8. An improved ion generating apparatus according to claim 3, wherein said means for generating an electrostatic field comprises power supply means adapted to create an electrostatic field in excess of 10,000 volts/cm at said outlet end of said nozzle.

9. An improved process for generating a high intensity ion beam, comprising the steps of feeding a species to be ionized through a small nozzle having a small tip at its outlet end with a very small orifice in the tip, and generating a high intensity electrostatic field adjacent the tip so as to produce a high intensity ion beam caused by collisions of electrons with atoms of said species.

10. The improved process according to claim 9, and further comprising the step of extracting the ions produced.

11. The improved process according to claim 9, wherein said step of generating said high intensity electrostatic field comprises generating a field of at least about 10,000 volts per centimeter adjacent said tip.

12. The improved process according to claim 9, wherein said process is carried out at about room temperature.

13. The improved process according to claim 9, wherein said process is carried out in the substantial absence of heat.

14. The improved process according to claim 9, wherein said process is carried out in the absence of heat affecting the ionization phenomena.

15. The improved process according to claim 9, wherein said process is carried out in the absence of an electron-emitting cathode.

16. The improved process according to claim 9, wherein said step of feeding said species to said nozzle comprises feeding a gaseous species.

* * * * *